US011523642B2

(12) United States Patent
Hartwick

(10) Patent No.: US 11,523,642 B2
(45) Date of Patent: Dec. 13, 2022

(54) WEARABLE BABY BURPING DEVICE AND SYSTEM

(71) Applicant: Sophia Irene Hartwick, Alexandria, VA (US)

(72) Inventor: Sophia Irene Hartwick, Alexandria, VA (US)

( * ) Notice: Subject to any disclaimer, the term of this patent is extended or adjusted under 35 U.S.C. 154(b) by 0 days.

(21) Appl. No.: 17/004,275

(22) Filed: Aug. 27, 2020

(65) Prior Publication Data

US 2022/0061414 A1 Mar. 3, 2022

(51) Int. Cl.
*A41D 1/215* (2018.01)
*A41F 9/00* (2006.01)

(52) U.S. Cl.
CPC ..... *A41D 1/215* (2018.01); *A41F 9/002* (2013.01)

(58) Field of Classification Search
CPC ..... A41D 1/215; A41D 1/21; A41D 2200/10; A41D 2400/482; A41D 13/0007; A62B 35/0025; A41F 9/00; A41F 9/002; A41F 9/005; A61F 5/0009; A61F 5/028; A61F 2007/0228; A61F 2007/023; A47D 13/046; A47D 13/086; A47D 13/08; A47D 13/025
See application file for complete search history.

(56) References Cited

U.S. PATENT DOCUMENTS 3,171,409 A * 3/1965 Cetrone ..... A61F 5/028 128/99.1
3,260,015 A 7/1966 Ryan
3,871,027 A * 3/1975 Orr ..... A41B 13/10 2/49.2
3,888,245 A * 6/1975 Berntson ..... A61F 5/028 602/19
4,592,342 A * 6/1986 Salmasian ..... A61F 5/0009 128/898
4,667,624 A * 5/1987 Smith ..... A01K 27/00 119/770
4,796,315 A * 1/1989 Crew ..... A61F 5/028 5/630
4,813,080 A * 3/1989 Toso ..... A41D 13/0007 2/94
4,873,735 A 10/1989 Fermaglich et al.
5,016,291 A * 5/1991 Capper ..... A41F 9/002 2/221
5,063,615 A * 11/1991 Chernuchin ..... A41F 9/002 2/338

(Continued)

FOREIGN PATENT DOCUMENTS

AU 2018263770 A1 10/2019
CN 109953846 A 7/2019

(Continued)

*Primary Examiner* — Heather Mangine
(74) *Attorney, Agent, or Firm* — Howard University School of Law

(57) ABSTRACT

A wearable belt device system and portable hand strap system configured to burp a baby. A belt may be adapted to extend around the waist of a wearer or a torso of a wearer. A compressible mound is placed on the baby's adnominal pressure being delivered in order to release gas contained within the baby. A handheld strap may be configured for wear to fit around a palm of a hand of a wearer. A mound may be affixed to the strap and may be adapted to compress an abdomen of a baby thereon.

8 Claims, 9 Drawing Sheets

(56) References Cited

U.S. PATENT DOCUMENTS 5,147,261 A * 9/1992 Smith ..... A61F 5/028 2/338
5,205,815 A * 4/1993 Saunders ..... A41D 13/0525 450/150
5,226,195 A * 7/1993 Pappas, Jr. ..... A41F 9/002 2/321
5,540,188 A * 7/1996 Heinrichs ..... A47D 13/086 119/770
5,638,772 A * 6/1997 Kaufmann ..... A47D 13/086 119/770
5,766,114 A * 6/1998 Campbell ..... A47D 13/025 441/108
5,806,087 A * 9/1998 Grotefend ..... A41F 9/005 2/1
5,960,471 A 10/1999 Burton
5,993,480 A * 11/1999 Burrows ..... A61F 7/02 607/112
6,223,854 B1 * 5/2001 Nolz ..... A41D 13/0007 182/133
6,325,023 B1 * 12/2001 Elnatan ..... A47D 13/046 119/770
6,336,908 B1 * 1/2002 Slautterback ..... A41F 9/002 2/312
6,419,652 B1 * 7/2002 Slautterback ..... A61F 5/028 128/96.1
6,446,269 B1 * 9/2002 Bessler ..... A41F 9/00 2/321
6,651,594 B1 * 11/2003 Bagwell ..... A47D 13/086 119/770
9,398,973 B1 * 7/2016 Goodson ..... A61F 5/028
9,433,243 B1 * 9/2016 Blakeney ..... A41D 1/215
11,109,689 B1 * 9/2021 Heisey ..... A47D 7/01
2005/0137509 A1 * 6/2005 Ishkhanova ..... A61F 5/028 602/19
2005/0278854 A1 * 12/2005 Taricani ..... A47D 13/08 5/655
2006/0090248 A1 * 5/2006 McKenzie ..... A41F 9/00 2/338
2006/0090710 A1 * 5/2006 Zazzara ..... B62J 27/10 119/770
2006/0100682 A1 * 5/2006 Koffroth ..... A61F 7/10 607/114
2008/0230580 A1 * 9/2008 Rothschild ..... A45F 5/02 224/660
2008/0244802 A1 * 10/2008 Reder ..... A41D 1/215 2/52
2009/0078501 A1 * 3/2009 Mordecai ..... A41D 13/0007 182/6
2010/0095458 A1 * 4/2010 Chciuk ..... A47D 13/083 5/646
2010/0319133 A1 * 12/2010 Whitlock ..... A47D 13/08 5/655
2011/0209261 A1 * 9/2011 Lyle ..... A63H 33/006 2/49.1
2012/0112444 A1 * 5/2012 Nishino ..... B62J 27/10 280/808
2013/0205463 A1 * 8/2013 Leung ..... A41B 13/10 2/48
2013/0263361 A1 * 10/2013 Surya ..... A41D 31/145 2/243.1
2014/0076943 A1 * 3/2014 Ng ..... A47D 13/04 224/160
2014/0128788 A1 * 5/2014 Marshall ..... A61F 5/024 602/19
2014/0135673 A1 * 5/2014 Cohen ..... A61F 5/30 602/19
2015/0258362 A1 * 9/2015 Cornish ..... A63B 21/0004 482/124
2015/0258405 A1 * 9/2015 McCune ..... A63B 69/0093 434/253
2015/0342774 A1 * 12/2015 Dudkiewicz ..... A61F 5/028 602/19
2015/0360062 A1 * 12/2015 Oliver ..... A62B 35/0025 182/8
2016/0022078 A1 * 1/2016 Sclafani ..... A41F 11/16 2/315
2016/0029726 A1 * 2/2016 Khorsandi ..... A61F 5/02 2/300
2016/0051392 A1 * 2/2016 Dudkiewicz ..... A61F 5/34 602/13
2017/0196314 A1 * 7/2017 Glick ..... A44B 11/003
2017/0273815 A1 * 9/2017 Tu ..... A61F 5/028
2017/0332796 A1 * 11/2017 Krug ..... A61H 7/001
2019/0038183 A1 * 2/2019 Carr ..... A41F 9/002
2019/0069612 A1 * 3/2019 Hyde ..... B60R 21/0132
2019/0150634 A1 * 5/2019 Najafi ..... A47D 13/025
2019/0262161 A1 * 8/2019 Massimiani ..... A63B 71/1225
2019/0269258 A1 9/2019 Descamps et al.
2019/0282885 A1 * 9/2019 Popenhagen ..... A63B 21/065
2020/0107649 A1 * 4/2020 Fosse ..... A47D 13/025
2020/0163466 A1 * 5/2020 Telford ..... A47D 13/086
2020/0229615 A1 * 7/2020 Cummings ..... A45F 3/14
2021/0000265 A1 * 1/2021 Chuah ..... A47D 13/025

FOREIGN PATENT DOCUMENTS

GB 2521385 A * 6/2015 ..... A41D 1/215
WO WO-2010003010 A2 * 1/2010 ..... A61H 7/001
WO 2018/202657 A1 11/2018

* cited by examiner

WEARABLE BABY BURPING DEVICE AND SYSTEM

FIELD

The present disclosure relates to a wearable, portable system for use in burping a baby to relieve gas and provide comfort.

BACKGROUND

Many caregivers have a problem with relieving babies of gas that builds up in the abdomen. The main way to relieve this gas build up within babies is through manual burping, which is not always successful. Babies typically swallow an excess amount of air—this is especially the case for newborn babies. Swallowing excess air, in conjunction with not being burped often enough to relieve the air, can result in a number of problems which may include, the baby spitting up, appearing agitated or cranky, or being incredibly gassy. In addition, some babies may incur sleeping problems if they are not burped daily.

For instance, a baby may be awoken from an otherwise peaceful sleep due to having excess gas. In addition, a lack of effective burping has been linked to colic. While it is not clear if gas causes colic or if the babies develop gas as a result of swallowing too much air while crying, colic is a medical condition effects that can affect the well-being of a baby. Colic is defined as crying that last for more than three hours a day, for more than three days a week, for at least three weeks. A common and widely method to relieve gas in infants, is providing the infant with an ingestible solution. Most often, this is an over-the-counter remedy, including but limited to-specially formulated baby formula for "sensitive tummies" for "sensitive tummies", dissolving infant gas tablets, gripe water, and infant gas relief drops, where in the active ingredient is something called simethicone.

Simethicone is a mixture of polydimethylsiloxane and hydrated silica gel, and is widely used as a foaming agent in these formulas in order to decrease the surface tension of gas bubbles that form in the stomach and intestines. This allows the bubbles to more quickly, and easily form into one large bubble, thus acquiring an increased sensitivity to compression, making it easier "pop". And thus, allowing gas to be more easily expelled from the body.

Gripe water is another option that's often used by parents/caregivers. It is also an over-the-counter, liquid supplement. The active ingredient is mainly sodium bicarbonate, which neutralizes gastric acid, and is often formulated with various combinations of herbs such as fennel, ginger, chamomile, cardamom, licorice, cinnamon, clove, and peppermint. These ingestible solutions/remedies can cause allergic reactions or produce side effects. Hence, there is difficulty in burping a baby in a timely manner in order to afford the baby maximum comfort.

SUMMARY

In light of the foregoing background, the following presents a simplified summary of the present disclosure in order to provide a basic understanding of some aspects of said disclosure. This summary is not an extensive overview of the disclosure. It is not intended to identify key or critical elements of the disclosure or to delineate the scope of the disclosure. The following summary merely presents some concepts of the disclosure in a simplified form as to prelude to the more detailed description provided below.

Aspects of the present disclosure include a wearable device comprised of a compressible mound for use with babies to relieve excess gas in the stomach. In one aspect, a wearable baby burping system includes a belt having a first side and an opposing second side. The belt may be adapted to extend around the waist of a wearer or a torso of a wearer. The wearable baby burping belt system may include a compressible mound adapted to compress an abdomen of a baby thereon. In another aspect, the wearable baby burping belt system may include a mound adapted to compress an abdomen of a baby thereon. In one aspect, the compressible mound or mound may be affixed to the belt on the first side and extending away from the belt. In one aspect, a wearable baby burping belt system includes a positioning strap which is securely affixed to the belt on the first side. The positioning strap may be adapted to engage a rear torso of the baby to securely hold the abdomen of the baby against the compressible mound.

In one aspect, the proposed technology provides an easier and more time-efficient way for parents and other caretakers to burp a baby. In another aspect, the proposed technology provides helps prematurely born babies who may not be able to withstand the standard amount of pressure from a general burping on a shoulder of a human caregiver.

In other aspects, a compressible mound may contain material that is softer than a standard baseball, bifurcated evenly and yet not as soft as a pillow.

In yet another aspect, a wearable baby burping system includes a handheld strap having a first side and an opposing second side; a handheld strap being adapted to fit around a palm of a hand of a wearer in which the second side abuts the hand of the wearer; and a compressible mound adapted to compress an abdomen of a baby thereon, the compressible mound being affixed to the strap on the first side and extending away from the strap at the first side.

In other aspects, the usability of the compressible mound may be supported by the positioning strap. The position strap which may be affixed to the wearable device may provide support in keeping the baby in place and assisting in proper positioning in place so the device may work and relieve gas in the stomach.

In yet other aspects, the wearable device is comprised of a belt that may go around the waist of the caregiver. The wearable device belt may have a fastener placed on its back in order to facilitate closure of the belt around the waist.

In yet other aspects, although it is related to the aforementioned wearable device conceptually, the strap with an attached compressible mound in an alternative construction technology. The strap attaches to the center to the caregiver's palm with the compressible mound facing upwards ready for use on a baby's abdomen.

In yet other aspects, the wearable system may include a releasable fastener system disposed on the belt. In yet other aspects, the wearable system may include a releasable fastener system having a hook and loop system. In yet other aspects, the wearable device may include a compressible mound further having a semi-circular cross-section shape.

In yet other aspects, the wearable device may include a compressible mound further comprises a material having a hardness of Shore 00 2-50. In yet other aspects, the wearable device may include a compressible mound further comprises a material having a hardness of Shore A 10-50. In yet other aspects, the wearable device may include a compressible mound further comprises a polymeric foam material. In yet other aspects, the wearable device may include a positioning strap has a first end being affixed to the belt and a second end having a first buckle component thereon and wherein the belt includes a second buckle component which matingly engages the first buckle component.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

Figure 1:
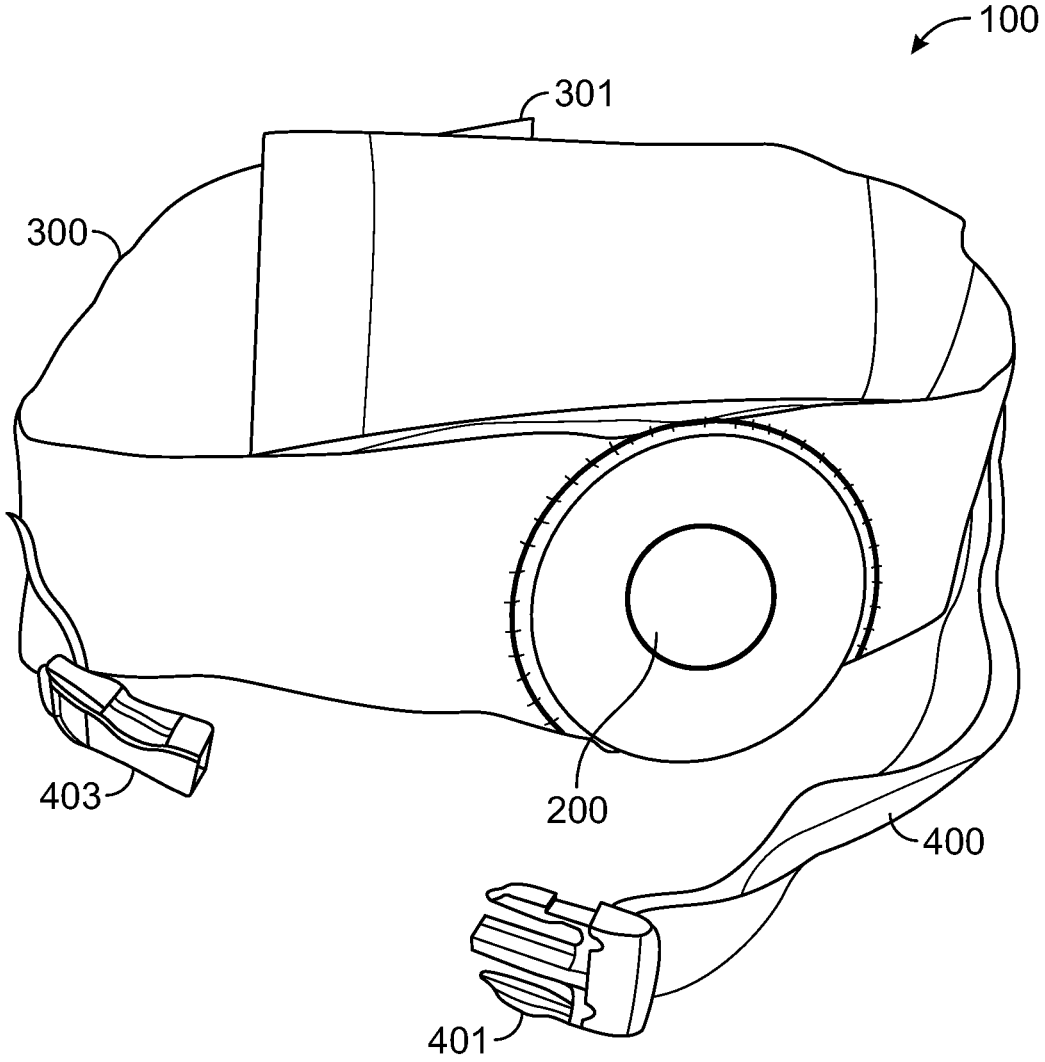
FIG. 1 is a slightly elevated view of a wearable device showing the belt, compressible mound and the positioning strap in which certain aspects of the present disclosure may be implemented.

The accompanying drawings, which form a part hereof, show examples of the disclosure. It is to be understood that the examples shown in the drawings and/or discussed herein are non-exclusive and that there are other examples of how the disclosure may be practiced.

"Configured for wear" can contemplate some amount of adjustment or additional configuration such as opening and/or closing fasteners (zippers, hook and loop (e.g., VELCRO®), snaps, etc.), and/or some amount of expansion such as one or more elastic regions and/or tight and loose fitting regions. Accordingly, the configuration of the wearable devices and the manner in which the wearable device is worn by an individual may vary.

Figure 2:
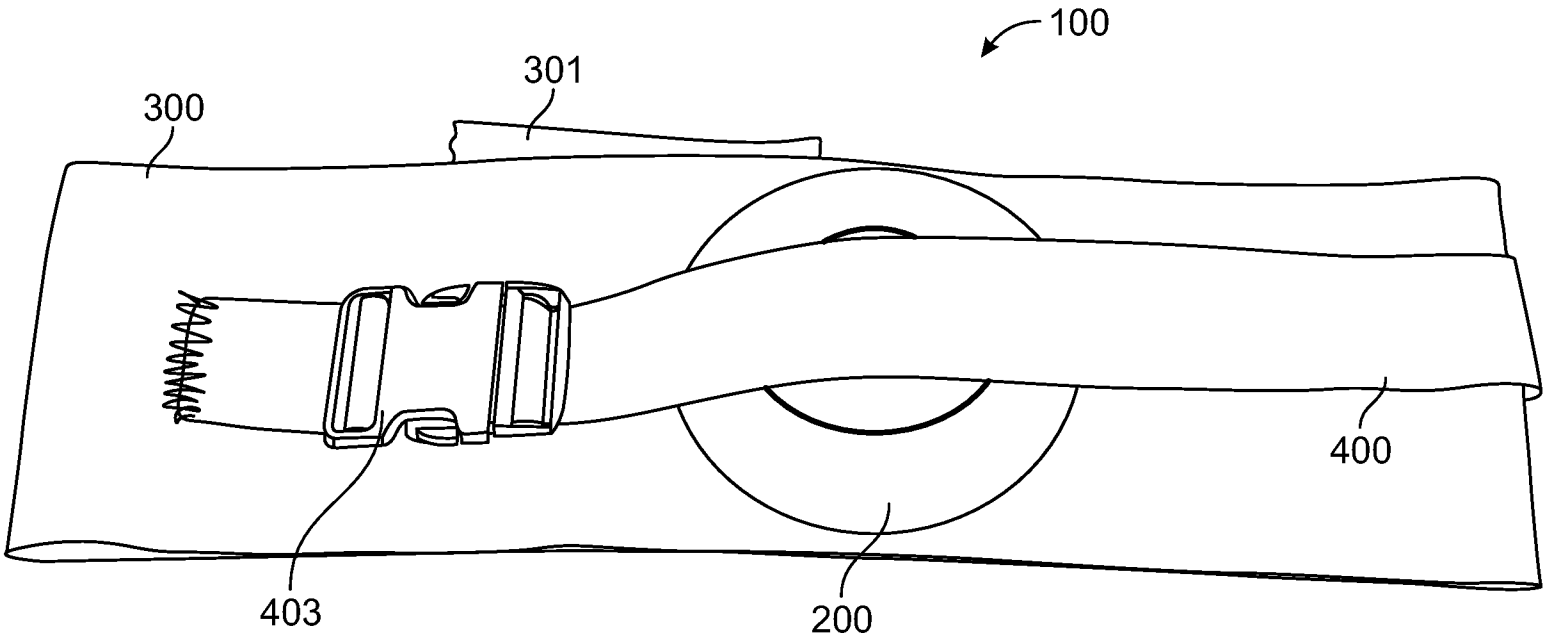
FIG. 2 is a face on view of the wearable device in a flat two-dimensional position. Showing how the positioning strap is configured over the compressible mound and where the fastener to close the and secure the positioning strap is placed which certain aspects of the present disclosure may be implemented.

FIGS. 1-9 illustrate aspects of a wearable device comprised of a compressible mound or mound for use with a human baby B to relieve excess gas in the stomach. Referring to FIG. 1, a wearable baby burping system 100 may include a compressible mound 200 disposed on a belt 300 with a positioning strap 400 for use with a baby. Referring to FIG. 2, the belt 300 may be configured for wear to be worn around a torso of wearer, such as the waist of the user (or wearer A, see FIGS. 7 and 8) and secured with a belt fastener system 301. Nevertheless, the belt 300 may also be configured for wear to be worn around a torso of wearer, such as the across the waist to the shoulder of the user. The fastener system 301 is provided to secure the wearable system 100 around the waist of the user with the belt 300. In one implementation, the tightness of the belt 300 around the waist of the wearer may vary by how it is affixed to the fastener system 301 by way of adjusting a diameter of the belt.

In one construction, the belt 300 may be constructed of a woven knit elastic composed of polyester fibers. In one construction, the width of the belt 300 may range between two inches to three inches or six inches to eight inches. Nevertheless, other constructions and widths are possible. In one construction, the fastener system 301 for the belt 300 may be positioned on the back of the belt 300. It is contemplated that the location of the fastener system 301 can be anywhere along the circumference of the belt 300. In one implementation, the fastener system 301 may be of a hook and loop construction, such as a patch of VELCRO® that can one of nylon hook and loop tape. A sewing thread may be used to secure the components of fastener system 301 to the belt 300. A sewing thread can be made from a synthetic fiber material, such as polyester. Nevertheless, the thread could be made of a natural material, such as cotton. Furthermore, it is contemplated that fastener system 301 have another releasable arrangement, including a male/female buckle configuration.

Figure 3:
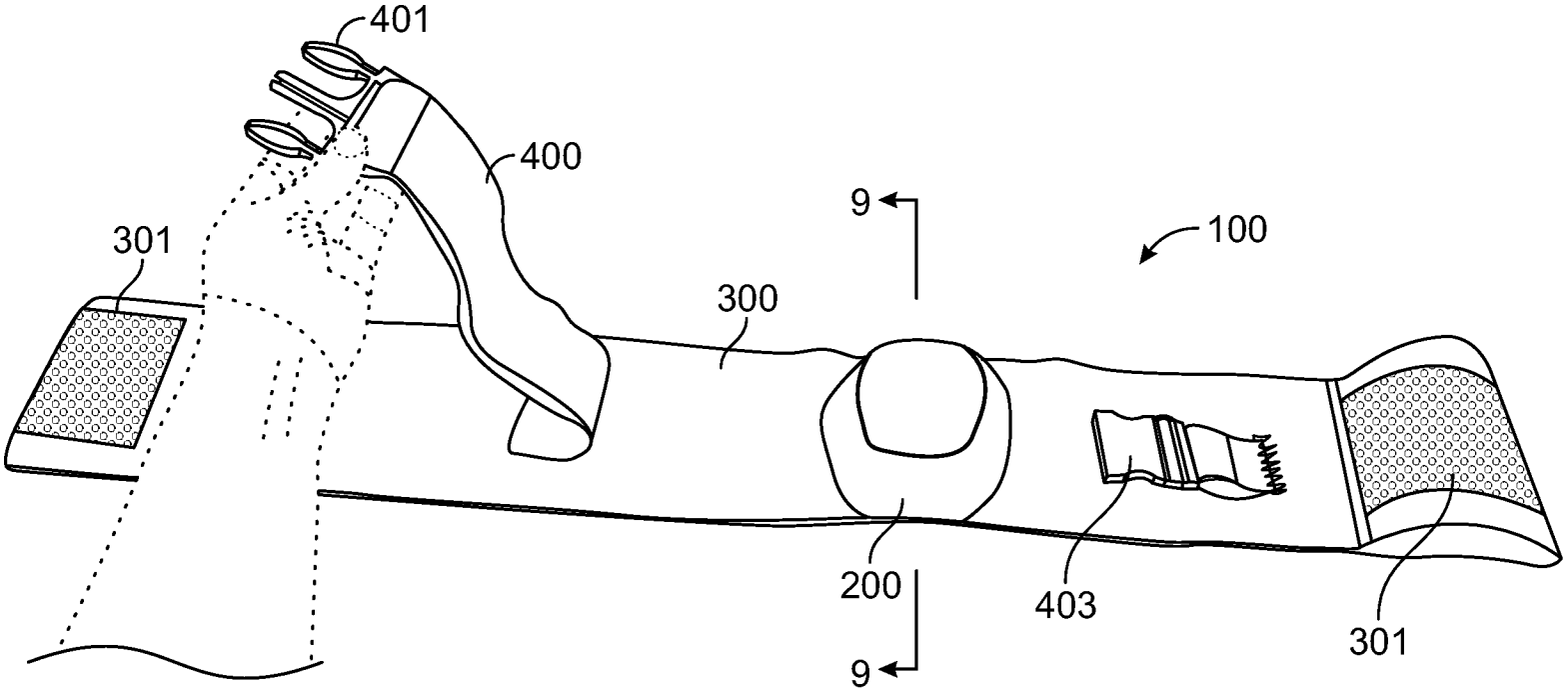
FIG. 3 is a front view of the wearable device in a flat two-dimensional position showing at least one implementation of how the position strap positioned when it is unsecured which certain aspects of the present disclosure may be implemented.

Referring to FIG. 3, the compressible mound 200 is arranged so that the distended abdomen of the baby can be positioned thereon in order to compress the baby's abdomen to enable ease of burping to relieve gas in the stomach when the overall system is in use. The compressible mound 200 can have a number of constructions. In one construction, the mound 200 may contain a material 205 that is softer than a baseball, yet not as soft as a pillow. In another construction, the mound 200 can be made a material 205 of high density EVA foam. High density EVA foam can be described as soft, yet very firm. As some more specific examples, the mound 200 may be made from a polymeric foam material 205, such as ethylvinyl acetate (EVA), polyurethane foam, and/or thermoplastic materials. In some implementations, the mound 200 may be formed of a material 205 having a hardness of Shore A 10-50 or a hardness of Shore 00 2-50. Preferably, mound 200 may be formed of a material 205 having a hardness of Shore A 20-30 or a hardness of Shore 00 20-25. Preferably, mound 200 may be formed of a material 205 having a hardness of Shore A 40-50 or a hardness of Shore 00 30-40. Potential materials used to form mound 200 may include EVA, polyurethane, polypropylene, polyethylene, or other thermoplastics which fall within the aforementioned hardness range. In one construction, mound 200 may have a hemispherical shape. In other constructions, the mound 200 may have a semi-circular cross-section shape taken at the centerline of the mound (see FIG. 9). In one construction, the mound 200 may be a diameter of about two to five inches and a height of ½ to two (2) inches. Although, other ranges are possible for the height and diameter for the mound 200.

Turning to FIG. 1, the wearable baby burping system 100 may include a positioning strap 400, a positioning strap male buckle 401, and a positioning strap female enclosure 403 which certain aspects of the present disclosure may be implemented. In one implementation, the positioning strap 400 functions to safely enable the baby to stay place in the event that the baby moves around and swivels during a belching activity. The fixed end of the positioning strap 400 is affixed to the belt 400 by way of a number of methods, including adhesive bonding or mechanical fastening (e.g., sewing thread). The free end of the strap 400 includes a positioning strap male buckle 401 that snap fits or otherwise matingly engages with the positioning strap female enclosure 403. Tension on the strap 400 ensures that the baby maintains the position once enclosed underneath the strap 400. In one construction, the strap 400 may be constructed of a woven knit elastic composed of polyester fibers or woven natural fibers, such as cotton or a blend of synthetic and natural fibers. Nevertheless, the strap 400 may constructed in a non-woven material such as an elastic material, polyurethane, polypropylene and the like. The buckle components 401, 403 can be made from heavy duty military grade plastic or other molded plastic material or molded metal material.

Figure 4:
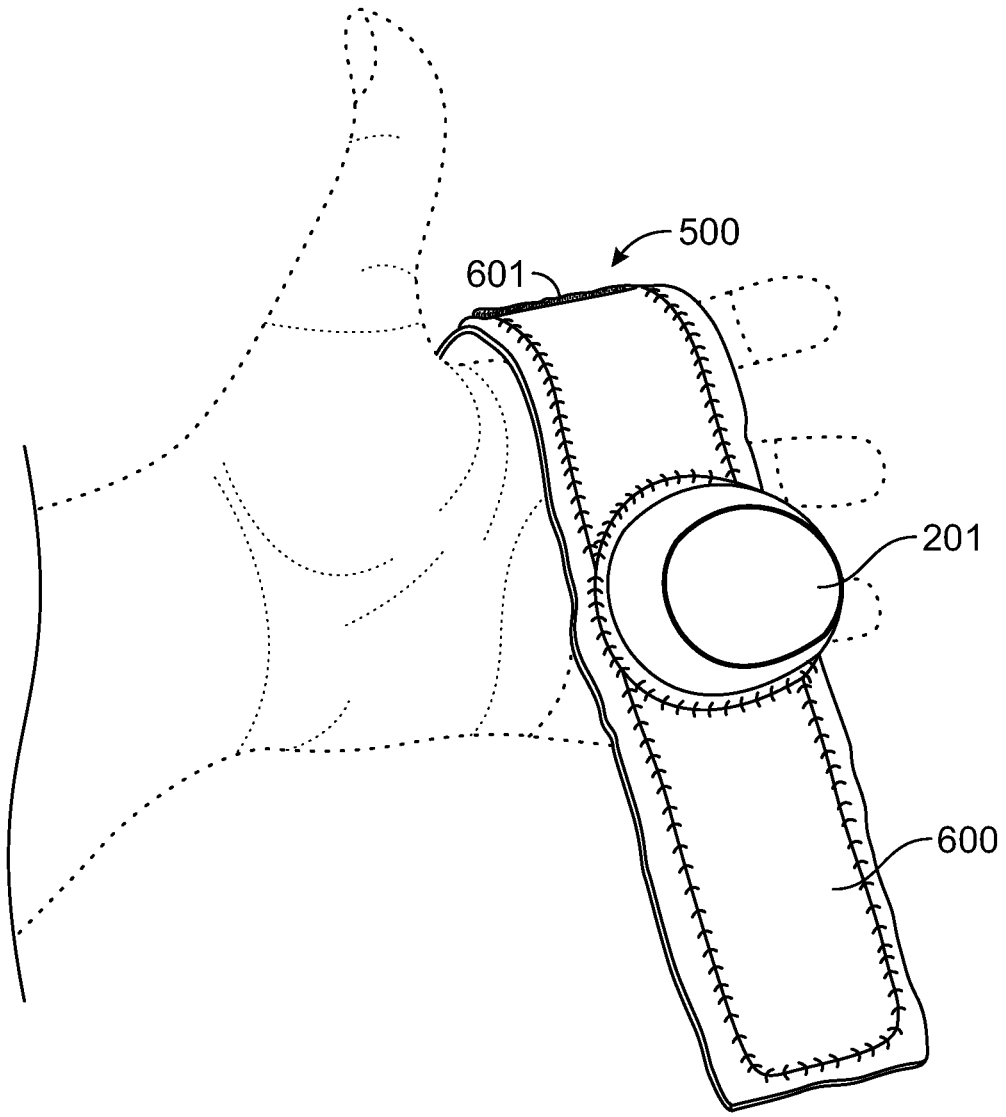
FIG. 4 is a perspective view of an alternative construction of a wearable baby burping system including a strap that goes around the hand and palm of a wearer and additionally showing the compressible mound accompanying the alternative strap construction which certain aspects of the present disclosure may be implemented.

FIG. 4 illustrates an alternative construction of a wearable baby burping system 500 in the form of a portable hand strap system. The portable hand strap system 500 has a similar purpose as the wearable baby burping system 100. This portable hand strap system 500 can be used in conjunction with system 100 and is better suited for "on-the-go" use; or use with babies who may have been born premature or generally smaller in size compared to babies their age; or allows for a more refined delicate burping activity on babies of any size.

Figure 5:
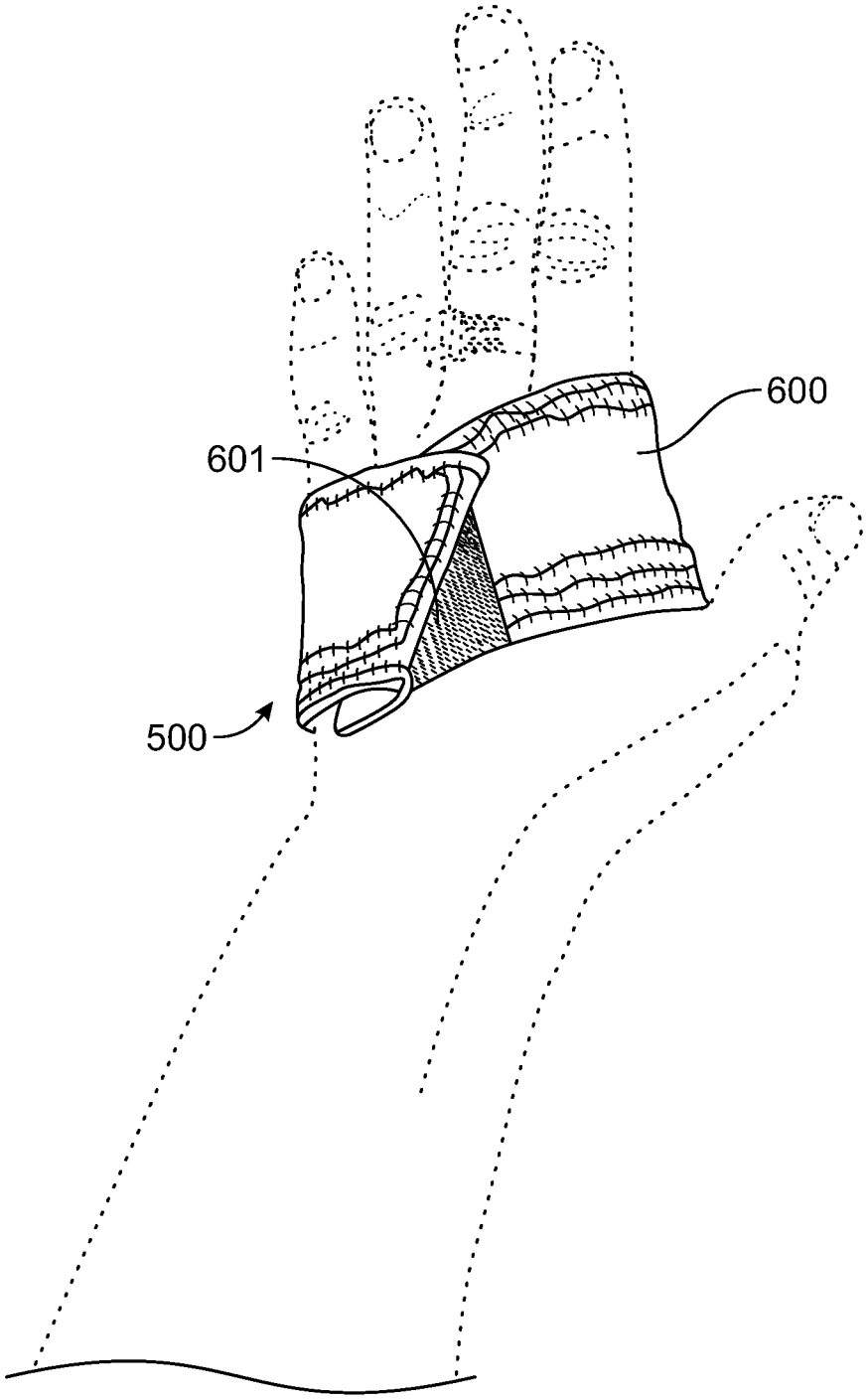
FIG. 5 is a perspective view of the alternative hand strap construction shown on a hand of a wearer showing at least one implementation of the enclosure portion and how it is secured for use.
Figure 6:
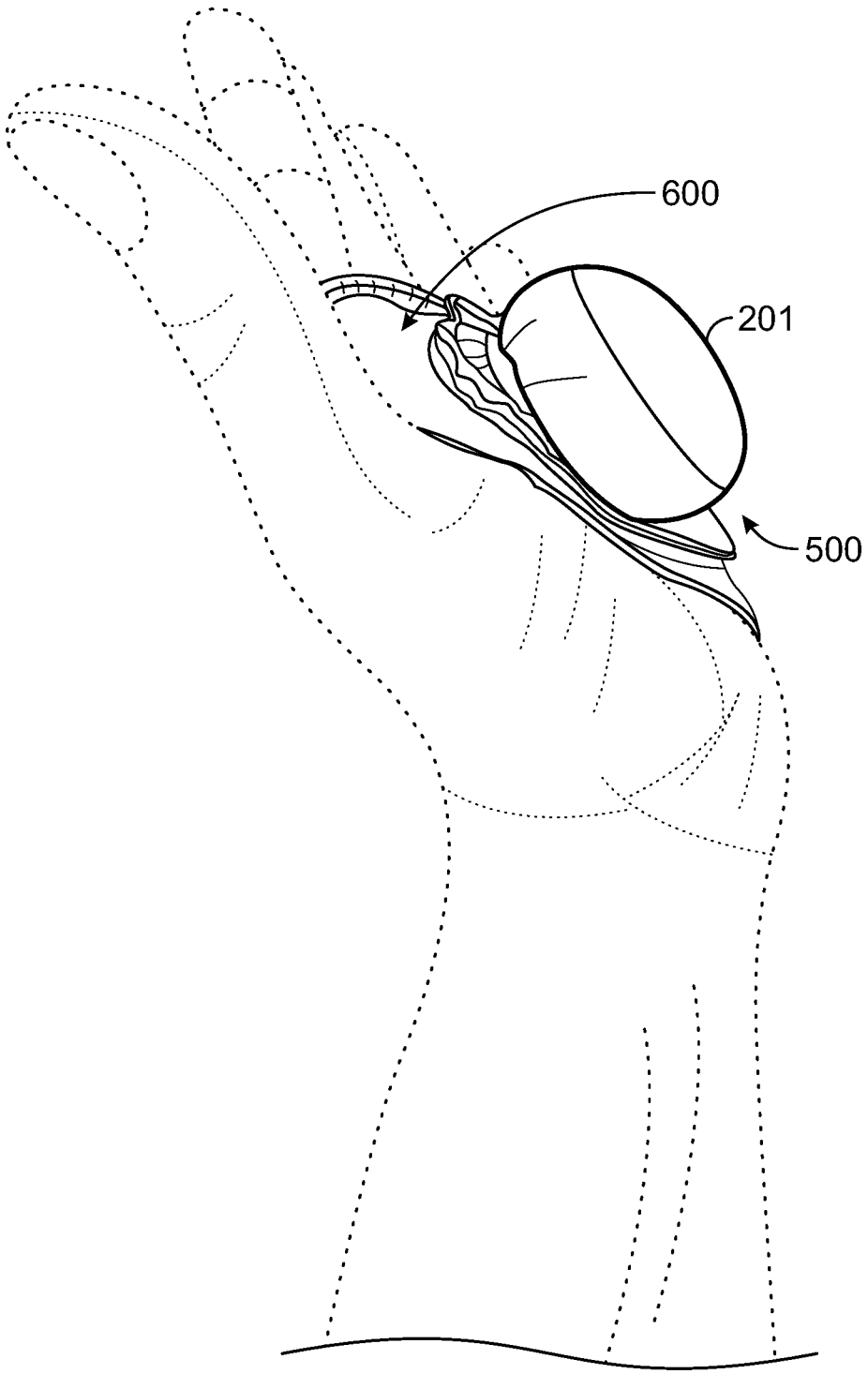
FIG. 6 is a close-up view on the compressible mound of the alternative hand strap construction with a slight view of the enclosures that ensures the strap is secure on the palm which certain aspects of the present disclosure may be implemented.

Referring to FIGS. 4-6, the hand strap 600 for the portable strap system 500 is configured for wear to fit around a hand of a wearer. As aforementioned, this arrangement provides a smaller more convenient system as it is smaller in size compared to the larger wearable device system 100. In one implementation, the tightness of the hand strap 600 around the hand of the wearer may vary by how it is affixed to the fastener system 601 by way of adjusting a diameter of the hand strap 600. In one construction, the hand strap 600 may be constructed of a woven knit elastic composed of polyester fibers or woven natural fibers, such as cotton or a blend of synthetic and natural fibers. Nevertheless, the hand strap 600 may constructed in a non-woven material such as an elastic material, polyurethane, polypropylene and the like.

Referring to FIG. 5, numeral 601 designates the hand strap fastener system. This fastener system 601 ensures the portable strap system 600 can be affixed and securely placed on the palm of the user. This allows for a comfortable wear and to be able freely move the hand and perform the burping process without the system falling off the user's hand. In one implementation, the fastener system 601 may be of a hook and loop construction, such as a patch of VELCRO® that can one of nylon hook and loop tape. A sewing thread may be used to secure the fastener system 601 to the hand strap 600.

Referring to FIGS. 4 and 6, the compressible mound 201 is adapted to fit in the hand of a wearer in the palm. The mound 201 has a substantially similar construction as the mound 200 affixed to the wearable device system 100. The minor difference between the two mounds 201 and 200 is size—diameter or width. In one construction, mound 201 may be 10%-40% smaller in diameter or width than diameter or width, respectively, of mound 200. The mound 201 is affixed strap 600 which is outside palm of the hand. In one operation, when the user anticipates that the baby is ready to burp, the user can conveniently rotate the mound 201 around directly to their palm to compress an abdomen of a baby thereon. With the mound 201 disposed the outside palm of the hand, users may use their free hand to attend to the baby being burped.

Burping a baby is an especially noteworthy issue because the health, safety, and comfort of a newborn baby can be a concern in a well-functioning society. A baby's well-being is a helpful predictor of the health of future generations, including future public health challenges for families, communities, and health care professionals. Moreover, the act of burping alleviates the air that babies tend to swallow when they are being fed that distends the abdomen. The aspects of the present disclosure relate generally to a wearable device comprised of a belt designed to be worn around the waist and compressible mound on the belt. In one aspect, a positioning strap is provided to hold a baby against the mound. Alternatively, a portable hand device/system may include of a hand strap and a compressible mound to enhance the health and well-being of the baby by enabling a burping activity.

Both burping devices 100, 500 are designed to be used quickly, and easily by their users. Also, both burping devices may be used daily and over time, without causing long term harm to an infant, or its parent/caregiver.

Figure 7:
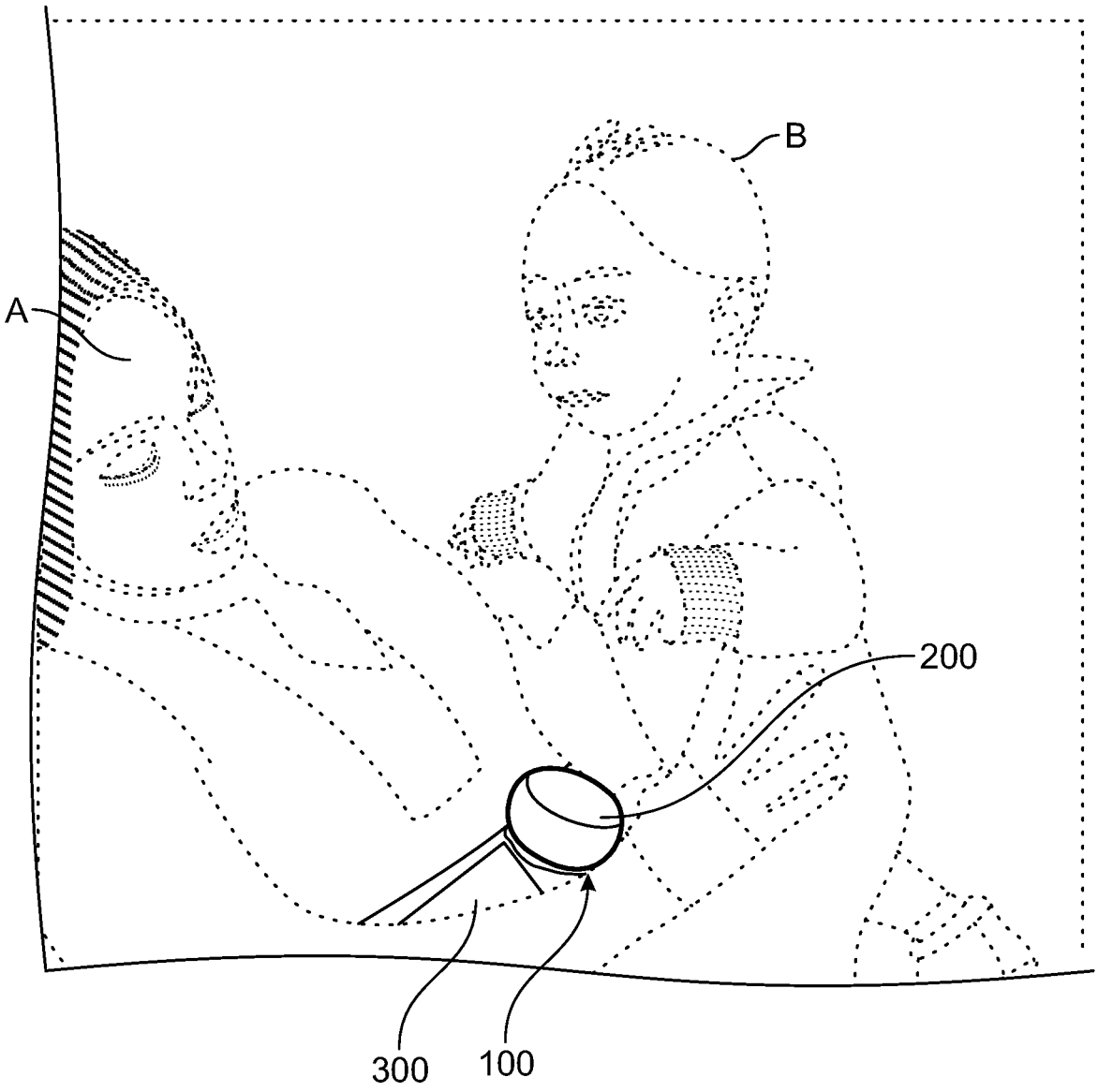
FIG. 7 is a side view illustrating a wearable device of FIG. 1 in-use prior to burping in which certain aspects of the present disclosure may be implemented.
Figure 8:
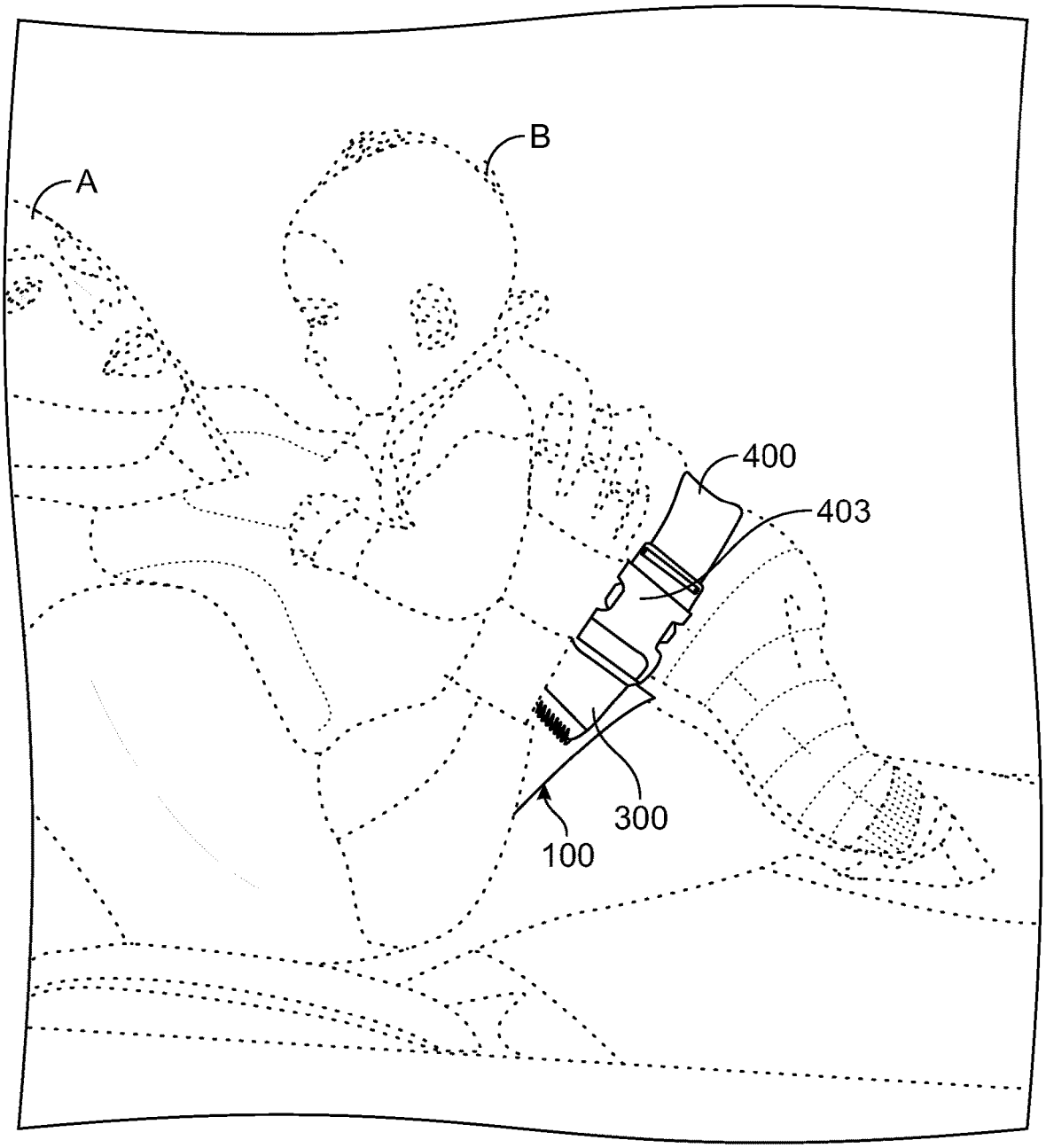
FIG. 8 is a side view illustrating a wearable device of FIG. 1 in-use in which certain aspects of the present disclosure may be implemented.
Figure 9:
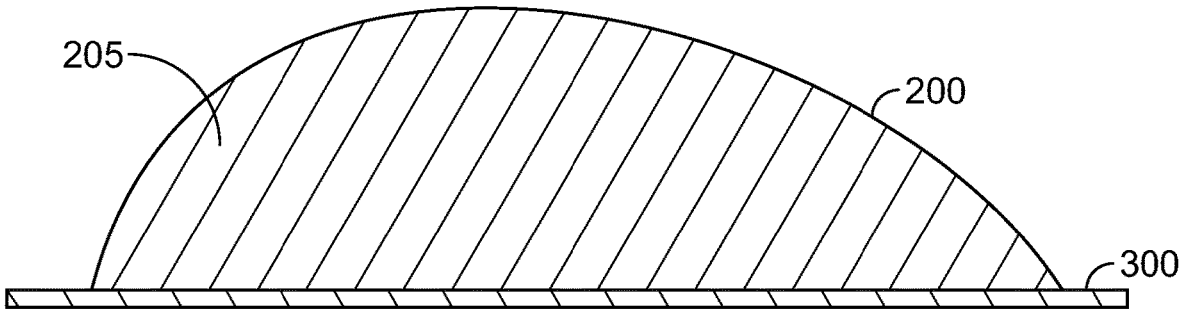
FIG. 9 is a cross-sectional view taken along line 9-9 of FIG. 3 illustrating a compressible mound construction which certain aspects of the present disclosure may be implemented.

Referring to FIGS. 7 and 8, in one in-use operation, when using the wearable baby burping system 100, the wearer A may lean back (if desired), and position the infant B so that its abdomen is on top of the center or apex of the mound 200. The further back, a wearer leans backward, a deeper gas release may result by more compression on the abdomen of the infant. In one in-use operation, parents/caregivers may burp an infant with the belt 300 while laying back, such as on a couch, or sitting in a chair that provide more incline positioning. By leaning back, and changing the baby's position from one that is either upright or supine (laying on one's back, face up), to a position that is more flat, or prone (laying face down on chest/stomach), it may manipulates the surface tension of gas bubbles in the infant's stomach and intestines, allowing a large bubble to form, and through positioning of the infant's belly atop the mound 200 of the belt 300, and through the compression caused by such positioning, a burp is produced.

The same general burping functions of system 100 are enabled by the hand-strap device 500, except that the wearer may not lean back, if desired. In one in-use operation, the wearer may fasten and wear the hand-strap 600 on their hand, in where the mound 201 is positioned on their palm, and bring the infant into a prone position, and while holding the infant with their free hand securely on the infants lower back or butt, use their strapped hand to hold the infant like a drink tray, so that infants belly is on top of the mound 200 of the hand-strap 600.

Aspects of the technology of the present disclosure helps prevent overuse of sodium bicarbonate that most likely results in imbalanced pH levels. While sodium bicarbonate-based and simethicone-based ingestible gas relief products for infants, contain chemicals such as GMOs, hormones, preservatives, artificial colors and flavors, sucrose, gluten binders and/or fillers, dairy, yeast dill, soy, petroleum-based products, and alcohol that may be undesirable for prolonged use in infants. The wearable devices 100, 500 comprised of a compressible mound for use with babies to relieve excess gas in the stomach prevent allergic reactions or prevent side effects caused by ingestible remedies. The wearable devices 100, 500 are designed with non-toxic materials not intended to be ingestible by an infant, and are ergonomically designed to provide as much comfort and safety to both the infant, and its parent/caregiver.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A wearable baby burping system, comprising:

a waist belt having a first side and an opposing second side; the belt being configured for wear to extend around a waist of a wearer;

a compressible mound being affixed to the belt on the first side and extending away from the belt on the first side and configured to extend away from the waist of the wearer; the compressible mound being adapted to compress an abdomen of a baby thereon; and a positioning strap being affixed to the belt on the first side; the positional strap having a first section and a second section; the first section having a first proximal end being affixed to the belt and a first distal free end having a first connector, and the second section having a second proximal end being affixed to the belt and a second distal free end having a second connector; the first connector and the second connector being configured to releasably interlock together; the positioning strap being adapted to engage a lower rear torso of the baby to securely hold the abdomen of the baby against the compressible mound for said baby at said waist of the wearer, while leaving the upper rear torso of the baby free of the positional strap.

2. The wearable system according to claim 1, further comprising a releasable fastener system disposed on the belt.

3. The wearable system according to claim 2, wherein the releasable fastener system includes a hook and loop system.

4. The wearable system according to claim 1, wherein the compressible mound further comprises a material having a hardness of Shore 00 2-50.

5. The wearable system according to claim 1, wherein the compressible mound further comprises a material having a hardness of Shore A 10-50.

6. The wearable system according to claim 1, wherein the compressible mound further comprises a polymeric foam material.

7. The wearable system according to claim 1, wherein the positioning strap comprises an elastic material.

8. The wearable system according to claim 1, wherein the compressible mound further comprises an ethylvinyl acetate material.

* * * * *